US005855396A

United States Patent [19]

Simpson-Jones et al.

[11] Patent Number: 5,855,396

[45] **Date of Patent: *Jan. 5, 1999**

[54] POSTCARD

[75] Inventors: Patrick Simpson-Jones, 18 Rue de Miromesnil, 75008 Paris; Jean-Jacques Degas, Gif St. Yvette, both of France

[73] Assignee: Patrick Simpson-Jones, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 638,353

[22] Filed: Apr. 26, 1996

[30] Foreign Application Priority Data

Apr. 27, 1995 [GB] United Kingdom ..... 9508594

[51] Int. Cl.[6] ..... B42D 15/02

[52] U.S. Cl. ..... 283/112; 229/92.8; 283/56

[58] Field of Search ..... 283/112, 81, 110, 283/56; 40/773; 229/92.8

[56] References Cited

U.S. PATENT DOCUMENTS

| | | | |
|---|---|---|---|
| 3,713,238 | 1/1973 | Hyman et al. | 40/773 |
| 3,847,325 | 11/1974 | Nasalski et al. | 229/92.8 |
| 4,079,881 | 3/1978 | Sabb | 229/92.8 |
| 4,237,633 | 12/1980 | Murrell | 40/773 |
| 4,662,093 | 5/1987 | Suttles et al. | 40/773 |
| 4,807,807 | 2/1989 | Glick | 283/112 X |
| 4,825,574 | 5/1989 | George | 40/158.1 |
| 4,947,566 | 8/1990 | Hoebel | 40/158.1 |
| 4,953,780 | 9/1990 | Ross | 283/81 X |
| 5,288,011 | 2/1994 | Yoshioka | 283/110 X |
| 5,428,423 | 6/1995 | Clark | 229/92.8 X |

FOREIGN PATENT DOCUMENTS

| | | |
|---|---|---|
| 0 189 817 | 8/1986 | European Pat. Off. . |
| 2 220 381 | 1/1990 | United Kingdom . |
| WO 89/06192 | 7/1989 | WIPO . |

*Primary Examiner*—Frances Han
*Attorney, Agent, or Firm*—Fish & Richardson P.C.

[57] ABSTRACT

A postcard comprising a generally planar portion having a front face adapted to receive and hold a photographic print, the postcard further comprising a stand extendible from the reverse face of the planar portion and operable to permit the planar portion to be stood on its side.

6 Claims, 2 Drawing Sheets

POSTCARD

The present invention relates to a postcard comprising a generally planar sheet of card or stiff paper. The sheet may have a picture applied to the face thereof.

Typically this type of postcard is sent with a picture relating to the place from which it is sent on the front face and on the reverse face, a greeting and the address of the intended recipient is written. Once received, and read, this type of card serves no further purpose. Frequently the card is simply discarded. Alternatively the card may be secured to a notice board using a pin.

It is an object of the present invention to provide an improved postcard of the above type.

According to the present invention, a postcard comprises a generally planar portion having a front face to which a picture has been applied or adapted for the application of a picture, the postcard further comprising a stand extendible from the reverse face of the planar portion and operable to permit the planar portion to be stood on its side.

In particular, the card is preferably adapted to be personalisable by the application of a picture in the form of a photographic print.

Thus, once received, the card may be displayed using the stand and without needing to fix the card to a notice board. Typically such a card is generally rectangular and has a long and a short side but it should be understood that in addition to these sides, the card may have any polygonal shape and may therefore have a corresponding plurality of sides.

Preferably the reverse face of the planar portion includes an address portion for the indication of an address of a recipient of the postcard, wherein the stand extends from the address portion. In this way, even with the stand extended, it is still possible to read the greeting written on the reverse face of the card in the remaining area of that face not forming the address portion.

A convenient arrangement for the stand comprises a flap defined in the reverse face by lines of weakness formed in the reverse face. Preferably one of the lines of weakness forms a fold line for folding the flap out of the plane of the planar portion to form an extending portion upon which the postcard rests when the planar portion is stood on its side. Advantageously, the lines of weakness not forming a fold line are formed by perforation of the reverse face. This permits the flap to be detached from the reverse face along these two perforated lines. Preferably the flap is generally triangular.

In the preferred embodiment, the postcard includes two of the triangular flaps each triangular flap being foldable to form a respective extending portion for standing the card on a respective one of a long and a short side of the planar portion. Preferably the two triangular flaps define in combination in the reverse face a generally rectangular shape having a diagonal line of weakness forming a common side of the two flaps. This generally rectangular shape may correspond to the address portion of the reverse face. In this way, the number of lines of weakness which must be formed is reduced.

The planar portion may comprise two substantially coextensive layers, the flap or flaps being defined in one of the layers, the other layer forming the front face.

Conveniently, the front face of the postcard may be adapted for the application of a photographic print beneath a protective, self-adhesive, transparent plastics layer. This permits the card to be personalised by the inclusion of a personal photographic print. Preferably also the layer beneath the plastics layer is self-adhesive so that the photographic print print is securely held beneath the plastics layer. The adhesive used on the plastics layer preferably combines chemically with the upper surface finish of the photographic print to ensure that the photographic print is clearly visible through the plastics layer.

The invention will now be described by way of example with reference to the drawings in which FIG. 1 is a plan view of a rear face of a postcard in accordance with the invention;

Figure 1:
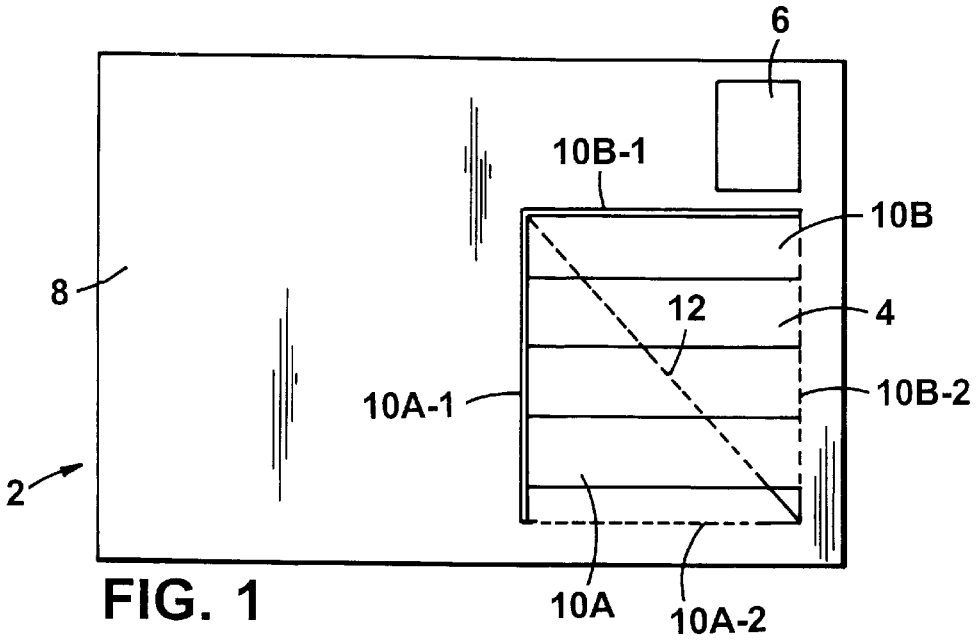

With reference to FIG. 1, the rear face of the postcard 2 has an address portion 4, an area for placing a stamp 6 and an area for writing a greeting 8.

In the address portion 4, two triangular flaps 10A, 10B are formed by lines of weakness 10A-1, 10A-2, 10B-1, 10B-2 and a common diagonal line of weakness 12.

The lines of weakness 10A-2, 10B-2, 12 are formed by perforating the material of the postcard and permit the triangular flaps 10A and/or 10B to be detached from the rear face 2 and folded out of the plane of the drawing and out of the plane of rear face along fold lines 10A-1 and 10B-1 respectively. In the preferred embodiment, the card comprises two layers, the flaps being formed only in the rearmost layer.

Figure 2:
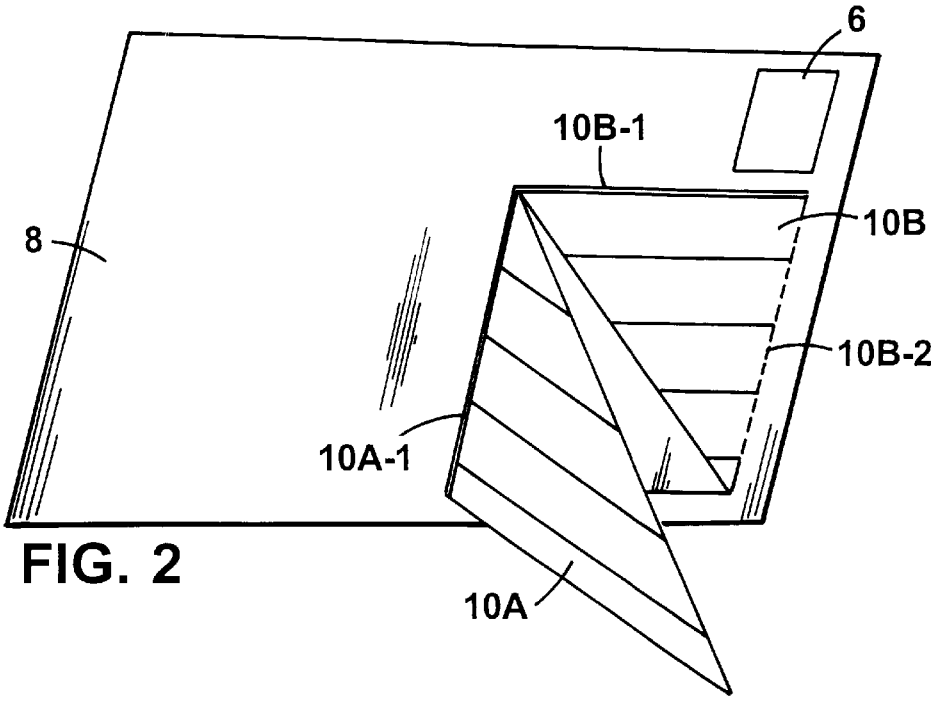
FIG. 2 is a perspective view of the postcard of FIG. 1.
Figure 3:
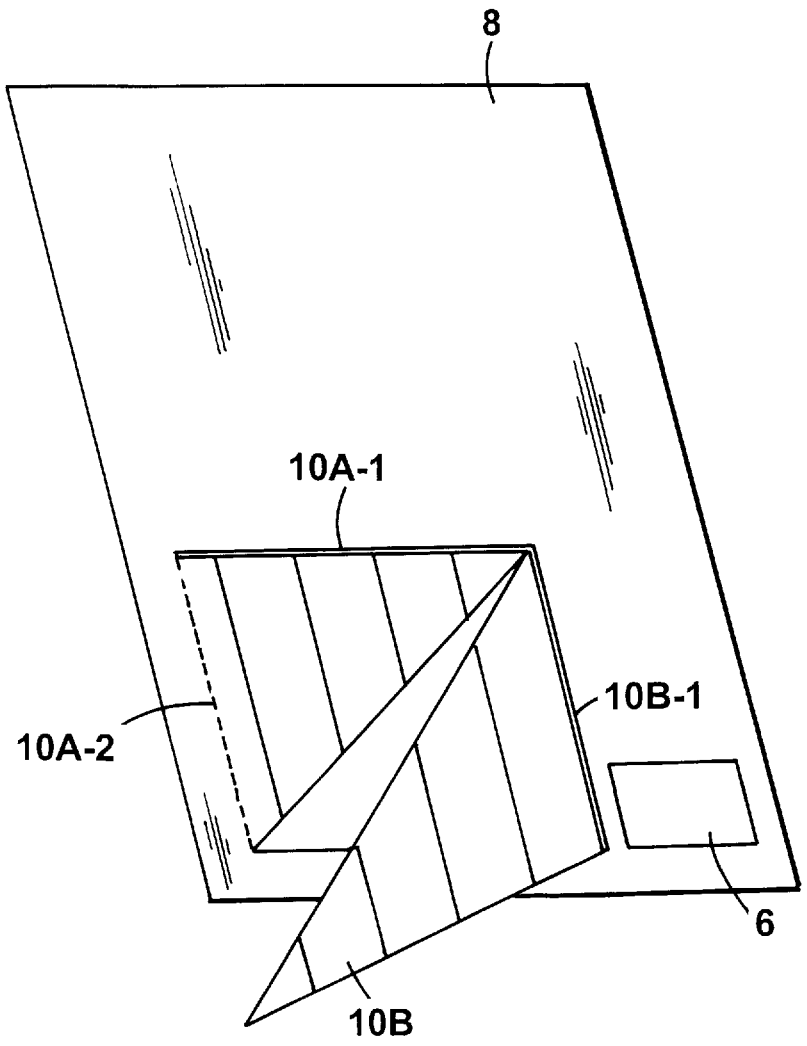
FIG. 3 is a perspective view of the postcard of FIG. 1 in an alternative orientation.

FIGS. 2 and 3 show the triangular flaps 10A and 10B respectively folded as described above. In this folded position, the triangular flaps form extending portions which as shown in FIGS. 2 and 3, permit the planar portion of the card to be stood on its side. The thickness of the material (typically cardboard) from which the flaps are formed is chosen to ensure that the flaps do not bend under the weight of the postcard.

As will be seen from FIGS. 2 and 3, the two extending portions 10A, 10B allow the planar portion of the card to be stood on its long and short side respectively. It will be appreciated that the planar portion of the card need not be rectangular as shown in the drawings.

It will further be appreciated that the face of the postcard which is hidden in the drawings is adapted to receive a photographic print or is printed with a suitable picture as in the postcard known in the art.

By adopting the two layer construction described above, the flaps may be folded out from the rear of the card without disturbing an image printed on the front face of the card. Similarly, a two layer construction permits the flaps to be folded out without disturbing any adhesive connection between a photographic print and the card.

We claim:

1. A postcard comprising a generally planar portion having a front face and a reverse face, the front face being adapted to receive and hold a photographic print, the postcard further having a short side and a long side, and comprising a stand extendible from the reverse face of the planar portion and operable to permit the planar portion to be stood on either of said sides, wherein the stand comprises two flaps defined in the reverse face by lines of weakness formed in the reverse face and wherein two of the lines of weakness form fold lines for folding the flaps out of the plane of the planar portion to form a respective extending portion upon which the postcard rests when the planar portion is stood on either of said sides.

2. A postcard according to claim 1 in which said two flaps comprise two triangular flaps, each triangular flap being foldable to form a respective one of said extending portions for standing the card of a respective one of a long and a short side.

3. A postcard according to claim 1, wherein the front fact of the postcard is adapted for holding a photographic print beneath a protective, self-adhesive plastic, transparent layer.

4. The postcard of claim 1 wherein the reverse face is divided into a first portion characterized by markings for positioning thereon a postal address for the card, and a second portion arranged to receive a message thereon.

5. The postcard of claim 4 wherein the two flaps are formed to be folded selectively and independently from each other out of the first portion of the reverse face.

6. The postcard of claim 1 wherein the two flaps are defined by a line of weakness common to both flaps.

* * * * *